US005866518A

United States Patent [19]

Dellacorte et al.

[11] Patent Number: 5,866,518

[45] Date of Patent: Feb. 2, 1999

[54] SELF-LUBRICATING COMPOSITE CONTAINING CHROMIUM OXIDE

[75] Inventors: Christopher Dellacorte, Medina; Brian J. Edmonds, Cleveland, both of Ohio

[73] Assignee: The United States of America as represented by the Administrator of the National Aeronautics and Space Administration, Washington, D.C.

[21] Appl. No.: 786,360

[22] Filed: Jan. 16, 1997

[51] Int. Cl.[6] ..... C10M 103/04

[52] U.S. Cl. ..... 508/104; 75/232; 75/233; 428/469; 428/689; 428/696; 428/702

[58] Field of Search ..... 508/103, 104; 428/469, 689, 696, 702; 75/232, 233

[56] References Cited

U.S. PATENT DOCUMENTS

| | | | |
|---|---|---|---|
| 3,199,934 | 8/1965 | Van Wyk et al. . | |
| 3,419,363 | 12/1968 | Sliney et al. . | |
| 3,508,955 | 4/1970 | Sliney | 508/104 |
| 3,953,343 | 4/1976 | Sliney . | |
| 3,954,479 | 5/1976 | Jahn . | |
| 4,136,211 | 1/1979 | Sliney . | |
| 4,214,905 | 7/1980 | Sliney . | |
| 4,728,448 | 3/1988 | Sliney . | |
| 5,034,187 | 7/1991 | Sliney . | |

OTHER PUBLICATIONS

Development of solid Lubricants for high temperature rolling ceramic beaning. Toyota, Hiro shi et al. *Toraiborojisuto*, 41(2) 146–53, 1996.

NASA TM–107163 Tribological Evaluation of PS300: A New Chrome Oxide Based Solid Lubricant Coating Sliding Against $Al_2O_3$ From 20° to 650° C. C.DellaCorte National Aeronautics and Space Administration Lewis Research Center Prepared for the Joint Tribology Conference cosponsored by the American Sopciety of Mechanical Engineers and the Society of Tribologists and Lubrication Engineers in San Francisco, CA, Oct. 13–17, 1996.

NASA TM–107056 Preliminary Evaluation of PS300: A New Self–Lubricating High Temperature Composite Coating for Use to 800° C. C. DellaCorte and B.J. Edmonds National Aeronautics and Space Administration Lewis Research Center Prepared for the Energy Week Conference and Exhibition cosponsored by API and ASME in Houston, TX, Jan. 29 –Feb. 2, 1996.

NASA TM–107332 The Effect of Compositional Tailoring on the Thermal Expansion and Tribological Properties of PS300: A Solid Lubricant Composite Coating C. DellaCorte Lewis Reserach Center and J. A. Fellenstein Ohio Aerospace Institute Prepared for the Annual Meeting sponsored by the Society of Tribologists and Lubrication Engineers in Kansas City, Missouri, 1996. (Not published or delivered yet. Advance Copy furnished).

NASA TM–107183 The Effect of Couterface on the Tribological Performance of a High Temperature Solid Lubricant Composite From 25° to 650° C. Christopher DellaCorte National Aeronautics and Space Administration Lewis Research Center Prepared for the International Conference on Metallurgical Coatings and Thin Films sponsored by the American Vacuum Society in San Diego, California, Apr. 22–26, 1996.

Toyota, Niizeki et al., Japanese Journal of Tribology vol. 40, No. 12, (1995), pp. 1277–1289.

The Effect of Compositonal Tailoring on the Therman Expansion and Tribological Properties of PS300: A solid lubricant Composite Coating, Dellacorte & Fellenstein, 1996.

Tribological Evaluation of PS300: A New Chrome Oxide Based Solid lubricant Coating Sliding against $A1_2O_3$ from 25 to 650° C.

*Primary Examiner*—Jacqueline V. Howard
*Assistant Examiner*—Cephia D. Toomer
*Attorney, Agent, or Firm*—Kent N. Stone

[57] ABSTRACT

A self lubricating, friction and wear reducing composite material useful over a wide temperature range of from cryogenic temperature up to about 900° C. contains 60–80 wt. % of particulate $Cr_2O_3$, dispersed in a metal binder of a metal alloy containing Cr and at least 50 wt. % of Ni, Cr or a mixture of Ni and Cr. It also contains 5–20 wt. % of a fluoride of at least one Group I, Group II, or rare earth metal and, optionally, 5–20 wt. % of a low temperature lubricant metal. Such as Ag, Au, Pt, Pd, Rh and Cu. This composite exhibits less oxidation instability and less abrasiveness than composites containing chromium carbide, is readily applied using plasma spray and can be ground and polished with a silicon carbide abrasive.

18 Claims, No Drawings

SELF-LUBRICATING COMPOSITE CONTAINING CHROMIUM OXIDE

ORIGIN OF THE INVENTION

The invention described herein was made by employees of the United States Government and may be manufactured and used by or for the Government for Government purposes without the payment of any royalties thereon or therefor.

BACKGROUND OF THE INVENTION

1. Field of the Invention

The invention relates to a self-lubricating solid composite comprising chromium oxide dispersed in a metal binder. More particularly the invention relates to a friction reducing and wear resistant solid lubricant composite comprising $Cr_2O_3$ in a metal binder, along with metal fluoride and, optionally, a metal effective as a lubricant at low temperature, for use over a wide temperature spectrum from cryogenic (−185° C.) temperature to about 900° C.

2. Background of the Disclosure

There is an increasing need for durable solid lubricant materials which will operate over wide range of temperatures and at high speeds, for long periods of time. Such materials find increasing need in space satellites and vehicles, adiabatic diesel and advanced turbo machinery, process control valve stems, dry running stirling engine cylinders, high speed foil air bearings, rotating face valves, butterfly valve stems, and the like. Numerous advances in the art have been made over the last thirty years since early self-lubricating compositions, such as composites of silver, platinum, molybdenum disulfide, lead oxide and silicon dioxide were disclosed in U.S. Pat. No. 3,199,934. A significant advance was made by Sliney as a porous nickel-chromium alloy in which is dispersed, via infiltration, a metal fluoride eutectic and, optionally, a coating of the eutectic and silver on the outer bearing surface as disclosed in U.S. Pat. No. 3,419,363. However, the porous metal provided a greatly increased surface area and high temperature oxidation of these porous sintered metals posed significant problems at temperatures above about 700° C. This lead to the development of another self-lubricating composite in which the metal component is a porous high temperature alloy body which is either infiltrated with both metal fluorides and glass or via plasma spray codeposition of the component powders, as disclosed in U.S. Pat. No. 4,214,905. The presence of the glass in the composite increased the oxidation resistance of the metal binder. The silver is electrodeposited on the metal. A still further improvement in the art was the development of a more wear resistant composite of nickel-cobalt bonded chromium carbide with metal fluoride and silver which is known as PS/PM200 and is disclosed in U.S. Pat. No. 4,728,448 and which has been extensively published in the literature. While this material has met with much success as a durable, long lasting, wear resistant self-lubricating composite useful over a wide temperature range, it is expensive and the chromium carbide component is so hard as to require costly diamond grinding achieve the desired dimensions prior to service. Further, at very high temperatures of 800° C. or more in an oxidative environment such as air, the chromium carbide tends to oxidize. This degrades the friction and wear properties and causes slight dimensional swelling of the composite body. It would be a significant improvement to the art if a material were available with the strength, low friction and wear characteristics of the PS/PM200, without the drawbacks of very high temperature oxidative instability, high component cost and the need for expensive diamond grinding to polish the bearing surfaces and achieve the proper dimensions of the composite body.

SUMMARY OF THE INVENTION

The present invention relates to a metal bonded chromium oxide composite containing metal fluoride and one or more low temperature lubricating metal components. The composite of the invention is useful as a durable, self-lubricating, long life, low friction, oxidation and wear resistant material over a broad range of temperatures, from cryogenic temperatures (e.g., ~−185° C.) up to about +900° C. In its broadest sense the composite of the invention comprises metal bonded chromium oxide which contains a fluoride of at least one metal. The chromium oxide is preferably chromic oxide ($Cr_2O_3$) in which the chromium is trivalent. The metal binder provides structural strength to the composite over the temperature range of interest and comprises a metal alloy containing Cr and at least one of Ni, Co or mixture thereof, wherein said Ni, Co or mixture thereof is present in an amount of at least about 50 wt. % of the alloy. Alloys of Ni and Cr are preferred. The metal fluoride component comprises a fluoride salt of at least one metal selected from Group I and II metals and also rare earth metal. The presence of one or more low temperature lubricating metal components, while optional is preferred for many applications. By low temperature lubricating component is meant one or more metals (such as one or more noble metals) soft enough to provide lubrication at low temperatures, including cryogenic temperatures, yet exhibiting oxidation resistance along with a high enough melting temperature to enable it to be used over a broad temperature range. This composite material does not exhibit the oxidative instability that is exhibited by self lubricating composites comprising metal bonded chromium carbide at high temperatures (e.g., ~+800° C.). Further, unlike chromium carbide which is abrasive at higher temperatures, the chromium oxide component of the composite of the invention has been found to have lubricating properties at temperatures in the range wherein the carbide analog is abrasive. This composite comprising metal bonded chromium oxide is useful for foil and other bearings which must be durable, non-galling, have a low coefficient of friction, be self lubricating, operate over extreme temperature ranges and be oxidation resistant.

The metal fluoride component of the composite of the invention preferably comprises a fluoride of at least one metal selected from the group consisting essentially of a Group IA alkali earth metal, a Group IIA alkaline earth metal, and mixture thereof A eutectic of $BaF_2$ and $CaF_2$ has been used in at least one embodiment. While the presence of metal which will provide lubrication at low temperatures is optional, as this will limit the upper operating temperature of the composite, it is a preferred component for many applications. Useful low temperature metals include at least one metal selected from the group consisting essentially of Ag, Au, Pt, Pd, Rh, Cu and mixture thereof. One or more of Ag, Au, Pt, Pd and Rh are preferred because of their oxidation resistance. In one particular embodiment, the composite will contain from 60–20 wt. % $Cr_2O_3$, from 20–60 wt. % of a high Ni content Ni-Cr alloy, from 5 –20 wt. % noble metal and from 5–20 wt. % of a $BaF_2/CaF_2$ eutectic. While various techniques may be used to prepare a composite of the invention, including infiltration and hot isostatic pressing, it has been found convenient to plasma spray the composite onto a suitable substrate and then grind and polish the resulting coating or deposit with a silicon carbide abrasive.

DETAILED DESCRIPTION

The composite of the invention is less abrasive and more resistant to oxidation than composites containing chromium carbide. Further, whereas metal bonded chromium carbide self lubricating composites can only be ground with expensive diamond abrasive, the of the invention may be ground and polished using a silicon carbide abrasive. The $Cr_2O_3$ component of the composite provides hardness, wear resistance, thermal stability and exhibits a low coefficient of friction when used in sliding contacts. It is more oxidatively stable than other well known hard and wear resistant materials such as tungsten carbide, titanium carbide, titanium nitride and chromium carbide. It is also less expensive than chromium carbide and, unlike a self lubricating composite employing chromium carbide which must be diamond ground, the composite of the invention employing the $Cr_2O_3$ is readily ground using a substantially less expensive abrasive such as silicon carbide. Other advantages of using $Cr_2O_3$ instead of chromium carbide are that the $Cr_2O_3$ acts as a high temperature lubricant leading to reduced high temperature counterface wear. In contrast, the prior art chromium carbide utilized as the wear resistant component is abrasive to counterface materials, even at high temperatures. Particulate $Cr_2O_3$ is used in the composite of the invention. The particles are dispersed throughout the metal binder. The particle size of the $Cr_2O_3$ useful in the practice of the invention will broadly range from about 20–200 microns, with a particle size range of from about 40–120 microns preferred for plasma spray deposition applications. The metal binder, as set forth above, comprises an oxidatively stable metal alloy containing Cr and at least one of Ni, Co or mixture thereof, wherein said Ni, Co or mixture thereof is present in an amount of at least about 50 wt. % of said alloy, with alloys of Ni and Cr preferred. The function of the metal binder component is to provide structural strength to the composite over the operating temperature range of interest and under bearing loads which often exceed unit stresses of about 35 $MN/m^2$. Such alloys include chromium and nickel super alloys such as the Iconels, nichromes, René 41 and the like. An alloy of 80% Ni and 20% Cr and other alloys set forth in the Tables below have been found to be particularly effective as a binder in the composite of the invention. The optional, but preferred low temperature lubricating metal of the composite of the invention will comprise at least one metal selected from the group consisting essentially of Ag, Au, Pt, Pd, Rh, Cu and mixture thereof, with one or more of Ag, Au, Pt, Pd and Rh preferred, due to their high temperature oxidation resistance. The maximum service temperature with copper or a high copper alloy is about 600° C. The maximum service temperature with a high content of a high melting noble metal such as Pt is about 900° C. A high silver content alloy also has a maximum service temperature of about 900° C. As stated above, while the presence of a metal or metal alloy which imparts low temperature lubrication to the composite is optional, for most purposes its presence is preferred. While the amount of these metals or alloys will range from about 0–20 wt. % and preferably 5–20 wt. % as set forth above, it will be appreciated that the time-temperature profile and the use environment for the bearing material will predicate the amounts of these components, particularly the relatively low melting silver and the less oxidative and chemically resistant silver and copper. Accordingly, bearing surfaces which are put into prolonged high temperature service, i.e., more than about 90% of their operating time at temperatures in excess of about 500° C., and especially if the use environment is oxidative, may incorporate significant amounts (50% or more) of higher melting and more oxidative resistant noble metals other than the less oxidative resistant copper, in the alloy. Thus, the preferred 5–20 wt. % low temperature alloy component of the composite under such conditions will comprise 50 wt. % or more of Ag, Au, Pt, Pd, Rh and mixture thereof, under high temperature, oxidative service conditions. Turning now to the metal fluoride component of the composite of the invention, it will be appreciated that numerous metal fluorides salts may be employed to achieve the desired high temperature lubrication features of the invention. As mentioned above, illustrative of such fluoride salts are the alkali and alkaline earth metal salts of Group IA and Group IIA metals of the Periodic Table of the elements, as well as fluorides of one or more of the rare earth elements (Lanthanide series), with eutectic fluoride mixtures of two or more such metals or elements being preferred. Particularly preferred are fluorides of barium and calcium, with the eutectic composition of barium and calcium fluoride being most preferred.

A composite of the invention may be prepared by a number of methods. These include infiltration in which a porous binder metal body formed by sintering a mixture of particulate $Cr_2O_3$ and hot pressed binder metal powder in a mold to form a porous body and then subjecting the porous body to double infiltration as disclosed, for example, in U.S. Pat. No. 4,214,905. Another method that may be used is a powder metallurgy method in which powders of the components are blended in the desired ratios and cold compacted by cold isostatic pressing to form a compact which is then sintered in hydrogen or the powder mixture is hot isostatically pressed after cold compacting, followed by sintering. These and other variations of the powder metallurgy methods are known and disclosed in U.S. Pat. No. 5,034,187. Both of these methods will form free standing bodies of the composite of the invention. The composite of the invention can also be formed directly on the desired substrate using plasma spraying (air or vacuum plasma spray), flame spraying and HVOF (High Velocity Oxygen Flame) spraying. For many applications in which the composite of the invention is desired to be applied as a self lubricating bearing on a surface of another material or body, such as on a rotating shaft and the like, it has been found to be more convenient to form the composite of the invention directly on the surface of the body by the use of air plasma spray deposition using known techniques for plasma spray deposition of such materials as disclosed, for example, in U.S. Pat. Nos. 3,953,343; 4,214,905 and 4,728,448, the disclosures of which are incorporated herein by reference. An advantage of air plasma spray codeposition is that the composite is formed directly on the material or body desired at a relatively low temperature which need not heat the substrate over about 150° C., thereby preserving the effects of any prior heat treatment and reducing the possibility of boundary layer formation and alloy segregation. The underlying substrate surface upon which the bearing composite is to be codeposited is grit blasted or otherwise cleaned to remove foreign materials, surface materials, and the like. Powders of the various components of the composite are then mechanically mixed and then ball milled (or equivalent) to achieve better dispersion and more intimate mixing to form a milled powder mix which is then plasma-arc sprayed onto the desired substrate at the desired thickness which may range, for example, from about 0.01 centimeters to about 0.06 centimeters and subsequently ground back to the desired thickness and polished using conventional grinding tools with a silicon carbide or other suitable abrasive.

The invention will be further understood with reference to the examples below.

EXAMPLES

In the following examples, friction and wear tests of various embodiments of the composites of the invention were conducted using air plasma spray coated disks sliding against superalloy, hemispherically tipped pins in a high temperature pin-on-disk tribometer that has been described in detail in the art by Dellacorte and Sliney in, e.g., "Composition Optimization of Self-Lubricating Chromium-Carbide-Based Composite Coatings for Use to 760° C.", ASLE Transactions, Vol. 30, 1, pp 77–83, 1987, and which is known to those skilled in the art. These composites were also evaluated for expansion properties using known methods. The composites were formed by simple air plasma spraying a simple powder blend of the constituents in which powder particle sizes ranged from 20–150 $\mu$m. The plasma spray parameters used to apply the composite coatings are shown in Table 1. The coatings were characterized using cross section metallography, electron microscopy and x-ray fluorescence (for bulk composition analysis). Disk samples were prepared by spraying a 0.5 mm thick composite coating onto a grit blasted Inconel X-750 disks precipitation hardened to RC 32-34 and previously bond coated with a 0.1 mm thick NiCr (80/20) bond coat layer, and the composite coatings of the invention ground and polished with 600 grit silicon carbide paper to a thickness of 0.3 mm, as set forth in the paper referenced above. Pin specimens 9.5 mm in diameter, 25 mm long and hemispherically tipped with a 4.76 mm radius of curvature were machined from Inconel X-750 precipitation hardened to RC 32-34. The individual powder components used to prepare the composites of the invention were all at least 99 wt. % pure.

The thermal expansion coefficients of each sample were measured using a commercially available direct reading, contacting rod dilatometer. Free standing dilatometer samples were made by plasma spraying the simple powder blends into an aluminum trough pretreated with salt water to prevent adhesion and provide facile sample removal. Each sample rests against one end of an alumina trough and held in place with a spring loaded rod and placed within the constant temperature zone of a tube furnace. Temperature is measured with thermocouples and specimen length monitored by a linear variable differential transformer connected to the rod. Specimen temperature and length are read every minute by a computer data acquisition system. The thermal expansion coefficient values are defined as the change in specimen length which occurs between 70° and 200° C. divided by the 25 mm length and temperature change (500° C). Alumina and Inconel X-750 were used as calibration standards.

TABLE 1

| Parameter | Value |
|---|---|
| Current | 600 A |
| Voltage | 30–32 V |
| Standoff distance | 8–10 cm |
| Argon | |
| Arc gas flow rate | 35 sl/min. |
| Powder flow rate | ~1 kg/hr |
| Powder gas flow rate | 0.4 $m^3$/hr |

Examples 1–10.

Tables 2 and 3 contain the compositions of the composites of the invention and the experimental friction and wear results, respectively.

TABLE 2

| | Composition of Test Coatings, Wt. % | | | | |
|---|---|---|---|---|---|
| Experiment | Coating designation | NiCr[a]/Binder | $Cr_2O_3$ | Ag | $BaF_2/CaF_2$[d] |
| 1 | PS300 | 20 | 60 | 10 | 10 |
| 2 | PS301 | 33 | 50 | 8.3 | 8.3 |
| 3 | PS302 | 40.7 | 44.5 | 7.4 | 7.4 |
| 4 | PS303 | 47 | 40 | 6.7 | 6.7 |
| 5 | PS304 | 60 | 20 | 10 | 10 |
| 6 | PS305 | 60 | 25 | 7.5 | 7.5 |
| 7 | PS310 | 60[b] | 30 | 10 | 10 |
| 8 | PS311 | 50[b] | 20 | 10 | 10 |
| 9 | PS320 | 60[c] | 30 | 10 | 10 |
| 10 | PS321 | 60[c] | 20 | 10 | 10 |

[a]NiCr binder contains 80 wt. % Ni, 20 wt. % Cr
[b]Binder contains 55% Co, 25.5% Cr, 10.5% Ni, 7.5%, 0.5% C (1% other)
[c]Binder contains 90% Ni, 5.5% Al, 5% Mo
[d]BaF2/$CaF_2$ contains 68 Wt. % $BaF_2$, 32 wt. % $CaF_2$ eutectic mixture.

TABLE 3

| | Friction and Wear Results | | | |
|---|---|---|---|---|
| Disk coating | Temperature, °C. | Friction coefficient | Kpin, $mm^3$/N-m | Kdisk, $mm^3$/N-m |
| PS300 | 25 | 0.23 ± 0.05 | $3.9 \pm 0.5 \times 10^{-5}$ | $6.6 \pm 0.5 \times 10^{-5}$ |
| PS300 | 500 | 0.29 ± 0.04 | $1.3 \pm 0.3 \times 10^{-5}$ | $3.9 \pm 0.3 \times 10^{-4}$ |
| PS300 | 650 | 0.31 ± 0.01 | $3.1 \pm 0.8 \times 10^{-5}$ | $7.1 \pm 1.6 \times 10^{-4}$ |
| PS304 | 25 | 0.31 ± 0.05 | $0.96 \pm 0.3 \times 10^{-5}$ | $4.8 \pm 0.3 \times 10^{-4}$ |
| PS304 | 500 | 0.25 ± 0.02 | $0.32 \pm 0.5 \times 10^{-5}$ | $2.8 \pm 0.3 \times 10^{-4}$ |
| PS304 | 650 | 0.23 ± 0.02 | $0.38 \pm 0.4 \times 10^{-5}$ | $1.0 \pm 0.1 \times 10^{-4}$ |
| PS304 | 800 | 0.37 ± 0.03 | $6.9 \pm 2.0 \times 10^{-5}$ | $2.6 \pm 0.2 \times 10^{-4}$ |

The tribological friction and wear results in Table 3 above demonstrate that the composites of the invention exhibit low friction and wear. These data also indicate that that these low friction and wear properties are relatively insensitive to composite composition. This means that the composition can be readily tailored to for specific substrates and applications. Thermal expansion data was obtained for all of the composites and showed that they all exhibited similar thermal expansion properties, which varied from 8.2±0.3 for the PS300 to 12.4±0.5, 12.7±0.4 and 13.0±0.1 for the PS304, PS320 and PS321, respectively. The data suggested that the thermal expansion coefficient is largely controlled by the amount of binder and its nickel content.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentability and novelty which reside in the invention, including all the features and embodiments which would be treated as equivalents thereof by those skilled in the art to which the invention pertains.

What is claimed is:

1. A composite comprising:

metal bonded chromium oxide wherein the amount of said chromium oxide present in said composite ranges from about 20–60 wt. %, and said bonding metal is an alloy containing Cr and at least one of Ni, Co or mixtures thereof, wherein the amount of said bonding metal present ranges from about 20–60 wt.

5–20 wt. % of a metal fluoride, wherein said metal fluoride comprises a fluoride of at least one metal selected from the group consisting of a Group IA alkali earth metal, a Group IIA alkaline earth metal, rare earth metal, and mixtures thereof; and optionally, 5–20 wt. % of one or more low temperature lubricating metals selected from the group consisting of Ag, Au, Pt, Pd, Rh, Cu and mixtures thereof.

2. A composite according to claim 1 wherein said bonding metal comprises a metal alloy containing Cr and at least one of Ni, Co or mixture thereof, wherein said Ni, Co or mixtures thereof is present in an amount of at least about 50 wt. % of said alloy.

3. A composite according to claim 1 wherein said bonding metal is selected from the group consisting of nickel based superalloys, cobalt based superalloys and mixtures thereof.

4. A composite according to claim 3 wherein said metal fluoride comprises a mixture of calcium fluoride and barium fluoride.

5. A self lubricating friction and wear reducing composite material useful over a wide temperature range of from cryogenic temperature up to about 900° C. consisting of from about (I) 60–80% of metal bonded, particulate $Cr_2O_3$, wherein said bonding metal is an alloy containing Cr and at least one of Ni, Co or mixtures thereof (ii) 5–20 wt. % of a fluoride of at least one metal selected from the group consisting of a metal of Group IA, Group IIA, rare earth metal and mixtures thereof, and optionally, (iii) 5–20 wt. % of a low temperature metal lubricant selected from the group consisting of Ag, Au, Pt, Pd, Rh, Cu and mixtures thereof.

6. A composite according to claim 5 wherein said metal fluoride is at least one metal selected from the group consisting of a Group IA alkali earth metal, a Group IIA alkaline earth metal, and mixtures thereof.

7. A composite according to claim 6 wherein said low temperature metal is selected from the group consisting of Ag, Au, Pt, Pd, Rh, Cu and mixtures thereof.

8. A composite according to claim 7 wherein said bonding metal is selected from the group consisting of nickel based superalloys, cobalt based superalloys and mixtures thereof.

9. A composite according to claim 7 wherein said $Cr_2O_3$ is present in an amount of from about 20–60 wt. %.

10. A composite according to claim 2 wherein said bonding metal is selected from the group consisting of nickel based superalloys, cobalt based superalloys and mixtures thereof.

11. A composite according to claim 4 wherein said bonding metal is selected from the group consisting of nickel based superalloys, cobalt based superalloys and mixtures thereof.

12. A composite according to claim 5 wherein said bonding metal is selected from the group consisting of nickel based superalloys, cobalt based superalloys and mixtures thereof.

13. A composite according to claim 6 wherein said bonding metal is selected from the group consisting of nickel based superalloys, cobalt based superalloys and mixtures thereof.

14. A composite according to claim 7 wherein said bonding metal is selected from the group consisting of nickel based superalloys, cobalt based superalloys and mixtures thereof.

15. A composite according to claim 9 wherein said bonding metal is selected from the group consisting of nickel based superalloys, cobalt based superalloys and mixtures thereof.

16. A composite comprising metal bonded chromium oxide wherein the amount of said chromium oxide present in said composite ranges from about 20–60 wt. % and said bonding metal is an alloy containing Cr and at least one of Ni, Co or mixtures thereof, wherein the amount of said bonding metal ranges from about 20–60 wt. %, said composite further containing 5–20 wt. % of metal fluoride, wherein said metal fluoride comprises a eutectic mixture of barium and calcium fluorides and, optionally, from 5–20 wt. % of one or more low temperature lubricating metals selected from the group consisting of Ag, Au, Pt, Pd, Rh, Cu and mixtures thereof.

17. A composite according to claim 16 wherein said bonding metal comprises a metal alloy containing Cr and at least one of Ni, Co or mixtures thereof, wherein said Ni, Co or mixture thereof is present in an amount of at least about 50 wt. % of said alloy.

18. A composite according to claim 17 wherein said bonding metal is selected from the group consisting of nickel based superalloys, cobalt based superalloys and mixtures thereof.

* * * * *